US010219557B2

(12) United States Patent
Bot et al.

(10) Patent No.: US 10,219,557 B2
(45) Date of Patent: Mar. 5, 2019

(54) METHOD AND APPARATUS FOR A WEATHER-RESISTANT FACIAL PROTECTION MASK

(71) Applicants: Sonja Marleen Bot, Apex, NC (US); Hu Song, Tianjin (CN)

(72) Inventors: Sonja Marleen Bot, Apex, NC (US); Hu Song, Tianjin (CN)

( * ) Notice: Subject to any disclaimer, the term of this patent is extended or adjusted under 35 U.S.C. 154(b) by 325 days.

(21) Appl. No.: 15/161,391

(22) Filed: May 23, 2016

(65) Prior Publication Data

US 2017/0332710 A1 Nov. 23, 2017

(51) Int. Cl.
*A41D 13/11* (2006.01)

(52) U.S. Cl.
CPC ..... *A41D 13/1192* (2013.01); *A41D 13/1161* (2013.01); *A41D 2400/22* (2013.01); *A41D 2400/34* (2013.01)

(58) Field of Classification Search
CPC ..... A42B 3/20; A42B 3/222; A61F 9/04
See application file for complete search history.

(56) References Cited

U.S. PATENT DOCUMENTS 891,122 A * 6/1908 Wilcox ..... 2/206
3,768,100 A * 10/1973 Colman ..... A41D 13/1161 2/206
3,878,563 A * 4/1975 Pulju ..... A41D 13/1161 2/9
5,374,458 A * 12/1994 Burgio ..... A41D 13/1146 128/206.16
5,617,584 A * 4/1997 Brennan ..... A41D 13/11 2/172
9,522,084 B2 * 12/2016 Wilson ..... A61F 9/04
2013/0061372 A1 * 3/2013 Goldstein ..... A42B 3/20 2/411
2014/0245524 A1 * 9/2014 Stephens ..... A42B 3/20 2/424
2017/0095681 A1 * 4/2017 Smaller ..... A62B 18/02
2017/0172137 A1 * 6/2017 Wynalda, Jr. ..... A01M 31/004
2017/0258151 A1 * 9/2017 Roberts ..... A41D 13/1161

* cited by examiner

*Primary Examiner* — Tajash D Patel
(74) *Attorney, Agent, or Firm* — Coats & Bennett, PLLC

(57) ABSTRACT

A weather-resistant facial protection mask to be worn by a user in extreme outdoor environments is disclosed. The mask includes a facial covering constructed of a waterproof breathable fabric configured to prevent the passage of water while allowing water vapor to pass through. The mask also includes a port extending completely through the facial covering and positioned to align with the user's mouth. A screen mesh is attached to the facial covering and extends over the port, the screen mesh is non-absorbent. The mask also includes a head securing portion attached to the facial covering, the head securing portion constructed from a second material different from the first material of the facial covering, the second material is more stretchable than the first material.

20 Claims, 5 Drawing Sheets

METHOD AND APPARATUS FOR A WEATHER-RESISTANT FACIAL PROTECTION MASK

TECHNICAL FIELD

The present application relates generally to an improved facial protection mask and particularly to a weather-resistant facial mask for extreme conditions.

BACKGROUND

Outdoor recreation continues to increase in popularity. The increase is in part due to advancements made in both technology and materials that generally improve the ability of athletes, adventurers, climbers, skiers, and otherwise outdoor enthusiasts to participate in outdoor activities in a variety of places, environments and conditions. With the general increase in popularity of these outdoor activities, access to more extreme environments and under more rigorous conditions is likewise becoming more prevalent. The environments and conditions that the participants experience are often times extreme. The extreme conditions may be associated with either, the environmental (e.g., temperature, water, ice, etc.), atmospheric (e.g., high UV, high altitude), and/or under heightened physiological conditions (e.g., active, fast, deep aerobic breathing, etc). Because of the increasingly extreme conditions that people are exposing themselves to, protection, particularly head and face protection is becoming more important.

Some facial protection exists today. In particular, existing facial protection solutions may include materials, such as exclusively knitted or exclusively woven materials. Knitted materials tend to stick to the user's face, allow ice/snow to stick to the outside of the mask, too close to face for a desired air pocket, may stay wet from breath condensation, or have low breathability. Woven materials, on the other hand, may not stay securely around the head or on the face, may not be easily adjusted, or be too hot for aerobic activity or warm weather sports.

Additionally, the materials used generally require stitching for the seam and may increase chafing and lack the necessary water-resistance and breathability. Further, modifications made to the material either fail to provide for adequate protection from sun, wind, ice, snow, cold air or may be spaced inappropriately for adequate respiration. As described above, absorbent materials, such as knits, soak in breath moisture, becoming clammy or freezing against the skin due to trapped condensation. These materials are also porous allowing for snow and ice to stick to the outside which in turn cools and freezes the fabric. Thus, there is a need for devices and techniques that provide improved weather-resistant facial protection.

SUMMARY

According to one or more embodiments herein, a facial protection mask which may be worn by a user in extreme outdoor environments is disclosed. The mask includes a facial covering constructed of a waterproof breathable fabric configured to prevent the passage of water while allowing water vapor to pass through. The mask also includes a port extending completely through the facial covering and positioned to align with the user's mouth. A screen mesh is attached to the facial covering and extends over the port, the screen mesh is non-absorbent. The mask also includes a head securing portion attached to the facial covering, the head securing portion constructed from a second material different from the first material of the facial covering, the second material is more stretchable than the first material.

According to one aspect of the present disclosure, a facial protection mask to be worn by a user, includes a facial covering constructed of a first fabric with a first side configured to face towards the user and an opposing second side. The first fabric being waterproof and breathable, the first fabric is configured to prevent the passage of water while allowing water vapor to pass through. The facial covering further includes opposing first and second sections. The facial protection mask further includes a port extending completely through the facial covering and positioned to align with the user's mouth. The facial protection mask further includes a screen mesh attached to the facial covering and extending over the port, the screen mesh being more rigid than the first fabric, the screen mesh further being non-absorbent. The facial protection mask further includes a head securing portion including opposing first and second sections attached to the corresponding first and second sections of the facial covering. The head securing portion is constructed from a second fabric different from the first fabric, wherein the second fabric is more stretchable than the first fabric, and wherein the head securing portion and the facial covering form an enclosed opening configured to receive the user's head.

According to another aspect of the present disclosure, a method for facial protection using a facial protection mask may include aligning an opening of the facial protection mask with a user's head, the facial protection mask comprising a facial covering constructed of a first fabric (e.g., woven) and a head securing portion constructed of a second fabric (e.g., knit), where the second fabric is more stretchable than the first fabric. Further, the method includes stretching the head securing portion over the user's head, such that the head securing portion applies a lateral force across an upper section of the facial covering securing the facial covering to the user's face, the lateral force being isolated along the upper section of the facial covering at an upper edge of the upper section, such that a bottom section of the facial covering hangs freely off of and away from the user's head. Additionally, positioning a port that extends completely through the facial covering over the user's mouth. Still further, breathing through a screen mesh extended over the port and attached to the facial covering.

According to another aspect of the present disclosure, a facial protection mask, worn by a user, may include a facial covering with a horizontal axis and a vertical axis. The horizontal axis being perpendicular to the vertical axis, wherein the facial covering is constructed of a first fabric with a first side configured to face towards the user and an opposing second side, the first fabric being waterproof and breathable, the first fabric is configured to prevent the passage of water while allowing water vapor to pass through, the facial covering further comprising opposing first and second sections. Further, the mask includes a port extending completely through the facial covering and positioned to align with the user's mouth. Further, a screen mesh attached to the facial covering and extending over the port, the screen mesh being more rigid than the first fabric, the screen mesh further being non-absorbent. Further, a head securing portion comprising opposing first and second sections attached to the corresponding first and second sections of the facial covering, the head securing portion constructed from a second fabric different from the first fabric, wherein the second fabric is more stretchable than the first fabric, wherein the head securing portion and the facial covering form an enclosed opening configured to receive the user's head, and wherein the head securing portion is configured to apply a lateral force to an upper section of the facial covering at an upper edge of the facial covering parallel to the horizontal axis, such that a bottom section of the facial covering hangs freely off of and away from the user's head.

Of course, the present disclosure is not limited to the above features and advantages. Indeed, those skilled in the art will recognize additional features and advantages upon reading the following detailed description, and upon viewing the accompanying drawings.

BRIEF DESCRIPTION OF THE DRAWINGS

Aspects of the present disclosure are illustrated by way of example and are not limited by the accompanying figures with like references indicating like elements.

DETAILED DESCRIPTION

The facial protection mask which may be worn by a user in extreme outdoor environments is disclosed. The mask includes a facial covering constructed of a waterproof breathable fabric configured to prevent the passage of water while allowing water vapor to pass through. The mask also includes a port extending completely through the facial covering and positioned to align with the user's mouth. A screen mesh is attached to the facial covering and extends over the port, the screen mesh is non-absorbent. The mask also includes a head securing portion attached to the facial covering, the head securing portion constructed from a second material different from the first material of the facial covering, the second material is more stretchable than the first material.

Figure 1:
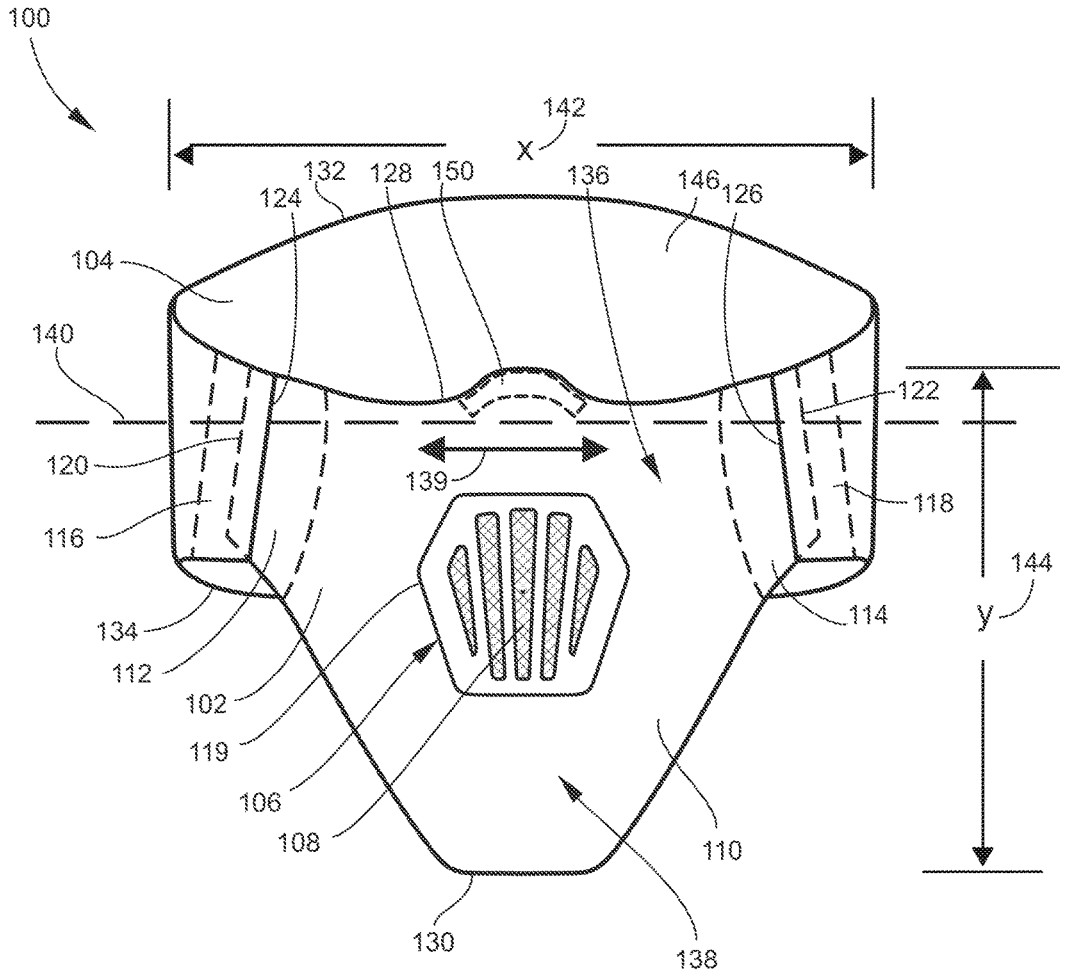
FIG. 1 illustrates an example exterior front view of a facial protection mask for the protection of a user's face according to one embodiment of the present disclosure.
Figure 2:
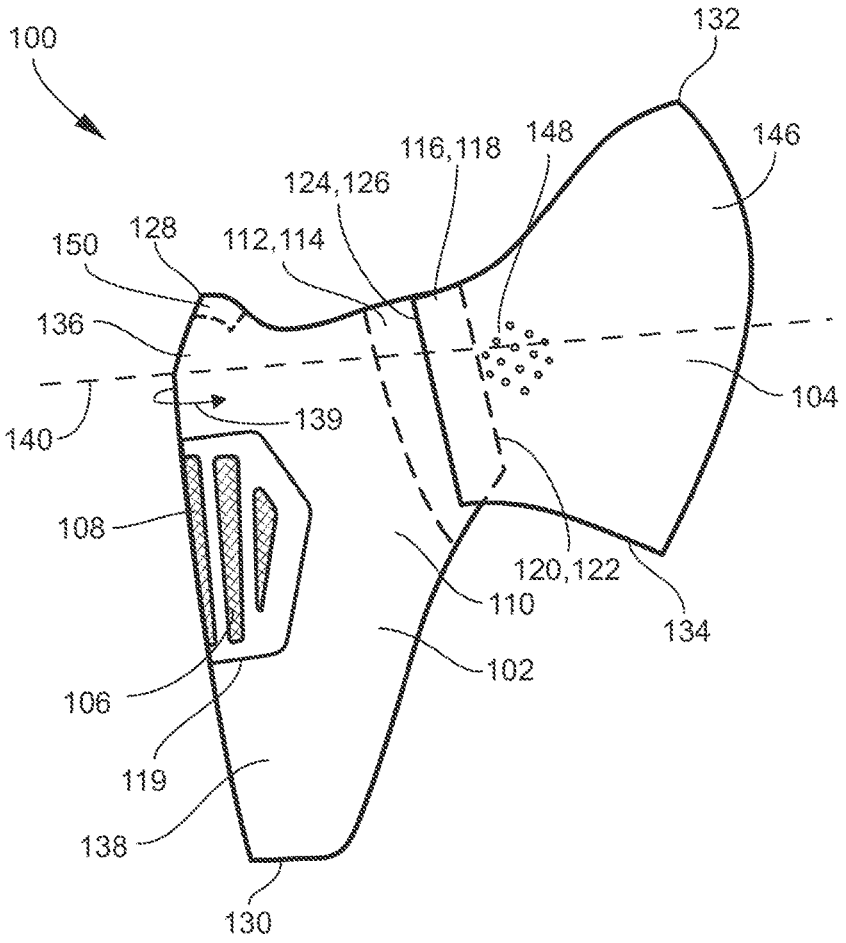
FIG. 2 illustrates an exterior side view of the facial protection mask of FIG. 1 according to one embodiment of the present disclosure.

FIG. 1 illustrates an example exterior front and side view of a facial protection mask 100 for the protection of a user's face according to embodiments in the present disclosure. The discussion herein will also reference FIG. 2, illustrating the facial protection mask 100 from the side perspective; and will be described in conjunction with FIG. 1. The facial protection mask 100 includes a facial covering 102 for covering a user's face for protection from weather and the environment (e.g., wind, sun, cold, wet or dry air, etc.). The facial protection mask also includes a head securing portion 104 attached to the facial covering 102 and used to help secure the facial covering 102 to the user's face. The facial protection mask may also include a port 106 forming an opening that extends through the facial covering 102 which allows the user to more easily breath and talk. Additionally, a screen mesh 108 may be attached to the facial covering 102 extending over the port 106 which provides for protection from the elements such as snow or ice, as an example.

The facial covering 102 is constructed of a first material 110, such as a woven material. The woven material, as used herein, may be a fabric generally formed of textile fibers. The woven material may be a material or fabric formed by weaving. The woven material may further be configured, if desired, to stretch in only a bias direction (between the warp and weft directions), unless the threads are elastic. The first material 110 may be a fabric that is waterproof and breathable. As an example, the first material 110 may be configured to prevent the passage of water (e.g., rain, snow, ice, etc.) while allowing the passage of water vapor (e.g., sweat, humidity, etc.). The first material 110 may, as an example, be polytetrafluoroethylene (PTFE) (e.g., GORE-TEX®), expanded-PTFE (ePTFE), MOUNTAIN HARDWARE® DRI.Q ELITE® (an eVent® variant), other examples may include POLARTEC® NEOSHELL®, although any material that provides for the passage of water vapor and while blocking the passage of water may be suitable for use, woven or otherwise. The first material 110 may also block visible or ultra-violet (UV) light. As an alternative, it is noted that the first material 110 may comprise any number of layers, including woven and knitted materials as non-limiting examples. The materials used herein for any portion of the facial protection mask 100, may also be carbon fiber based for increased insulative characteristics.

The first material 110 may be configured to resist stretching or may be configured to maintain a shape. The first material 110 may also include reflective material for the reflection of visible light and/or material configured to absorb light and subsequently emit this absorbed light (e.g., glows in the dark). The first material 110 or fabric may also include one or more fabric layers with at least an exterior fabric layer and an interior fabric layer. As an example, the exterior fabric layer may provide for abrasion resistance, thereby protecting an inner layer, where the inner layer prevents the passage of water and allows the passage of water vapor. The exterior fabric layer may also be constructed of a material having a higher friction coefficient relative to an inner layer or the interior fabric layer. This may be desired so as to allow a user to easily adjust the fit or positioning of the facial covering 102 as desired.

The facial covering 102 may include a first section 112 and a second section 114 and be attached to the head securing portion 104 at a first section 116 and a second section 118 of the head securing portion 104. The attached first section 112 of the facial covering and first section 116 of the head securing portion 104 may be attached using stitching, adhesives, and/or heat responsive bonding techniques using heat responsive bonding material 119. As an example, the heat responsive bonding material may include thermoplastic polyurethane (TPU) or other similar thermoplastic elastomers. Additionally, any combination of these techniques may also be used as appropriate. The head securing portion 104 may be attached to the facial covering 102 and wrapped around the user's head to hold the facial covering 102 to the user's face. In this manner, the head securing portion 104 and the facial covering 102 form an enclosed opening configured to receive the user's head The first and second sections 112, 114 of the facial covering 102 and the first and second sections 116, 118 of the head securing portion 104 are bounded laterally by first and second lateral edges 120, 122, 124, 126. The facial covering 102 and the head securing portion 104 may each have an elongated shape in the horizontal direction between each of their respective lateral edges. Additionally, the facial covering 102 includes an upper edge 128 and a bottom edge 130. The head securing portion 104 includes an upper edge 132 and a bottom edge 134. The facial covering 102 further includes an upper section 136 that includes the upper edge 128 and extends between the first and second lateral edges 120, 122, and a bottom section 138 that includes the bottom edge 130.

When attached to the first and second sections 112, 114 of the facial covering 102, the head securing portion 104 applies a lateral force 139 on the upper section 136 of the facial covering 102 when worn by the user, the lateral force 139 being isolated along the upper section 136 of the facial covering 102 at the upper edge 128 such that the bottom section 138 hangs freely off of and away from the user's head. The lateral force 139 may be applied laterally where the lateral force 139 is parallel to a horizontal axis 140. The lateral force 139 may alternatively be applied to the upper half portion of the facial covering 102. By hanging freely off of and away from the user's head, a gap between the facial covering and the user's face is formed. In this gap, a warmer pocket of air may be trapped providing increased insulation from the more extreme temperatures external to the facial protection mask 100.

With continued reference to FIG. 1, the facial protection mask 100 may have an X dimension 142 and a Y dimension 144 that varies based on the size of the user's head. As an example, the X dimension 142 may be between seventeen (17) to twenty-seven (27) centimeters, whereas the Y dimension 144 may be between seventeen (17) to twenty-five (25) centimeters.

The head securing portion 104 may be constructed from a second material 146 or fabric, where the second material 146 is different from the first material 110. The second material 146 may also be more stretchable than the first material 110. The second material 146 may be a knit material that may also be stretchable horizontally, vertically, and/or diagonally. Additionally, the facial protection mask 100, by using a stretchable second material 146 more stretchable than the first material 110 used on the facial covering 102, may self-adjust to the user's head. As an example, the second material 146 may be a knit material. The knit material may be a textile that results from knitting. The properties of the knit material may be distinct from woven material in that it is more flexible and can be more readily constructed into smaller pieces if necessary. Further, as distinct from woven fabric, knitted fabric may be comprised entirely of parallel courses of yarn. The courses are joined to each other by interlocking loops in which a short loop of one course of yarn is wrapped over the bight of another course. Alternatively, the head securing portion 104 may also include adjusting buckles or snaps to further shrink or expand the size of the opening in the facial protection mask 100 for receiving the user's head.

With continued reference to FIG. 1, the facial protection mask 100 may also include the port 106 forming an opening that extends through the facial covering 102 which allows the user to more easily breath and talk. The port 106 may also include one or more ports 106 where the one or more ports 106 are each spaced apart in the facial covering 102.

The screen mesh 108 may be attached to the facial covering 102 extending over the edges of the port 106, where the screen mesh 108 provides for protection from the elements such as snow or ice as an example. The screen mesh 108 may be constructed of a nylon based material, where the nylon based material is more rigid than either the first material 110 or the second material 146. The screen mesh 108 may be constructed of material that is non-absorbent and/or anti-microbial (e.g., an agent that kills microorganisms or inhibits their growth) as may be desired. This may be desired as the screen mesh 108 is placed directly over the port 106 in alignment with the user's mouth and nose. In this manner, the screen mesh 108 may prevent, reduce or slow undesired bacterial growth. The screen mesh 108 may also be constructed of polyester mesh, nylon mesh and stainless steel mesh based materials. The screen mesh 108 may have an increased ability to deflect or resist the accumulation of snow or ice than the first material 110 and or the second material 146. The screen mesh 108 material may also be non-toxic without additive toxins (e.g., softening phthalates typically used in plastic, no dye, etc.).

The screen mesh 108 may also include small holes configured to increase air flow during periods of high aerobic exercise by the user, while still providing the desired protections as described herein. As an example, the screen mesh 108 may have a rigid or semi-rigid mesh configuration with small, densely packed, non-collapsing holes so as to provide a vented mouth area that allows for increased air exchange. The increased air exchange reduces the build-up of condensation on the interior of the facial protection mask 100. Further, the screen mesh 108 may be constructed such that it remains stiff while the user breathes. Further, the sizing of the small holes in the screen mesh 108 may be sized to provide UV protection for the user. The sizing of the small holes in the screen mesh 108 may be further still configured such that the user may freely communicate via speaking.

The screen mesh 108 may be extended over the facial covering adjacent to the port 106 and may be bonded to the facial covering 102 by a TPU-based material. Other materials as described above, such as stitching or adhesives, may also be used in any combination. Alternatively, bonding the screen mesh 108 between one or more layers of the first material 110 as extended over the port 106 may be desired.

Additionally, the head securing portion 104 may further include one or more holes 148 in a side portion, where the holes 148 are aligned with the user's ears. In a similar fashion, the one or more holes 148 may be covered with a material such as that used for the screen mesh. In this manner, the material used to cover the holes 148, may use similar bonding techniques and materials, providing similar protections. A nose portion 150 may further be bonded or stitched onto or into the facial covering 102. The nose portion 150 may provide support for the facial covering 102 where the facial covering 102 is more securely held on the bridge of the user's nose.

With continued reference to FIGS. 1 and 2, the nose portion 150 may be configured so as to hold the facial covering away from the user's face as the facial covering hangs off of the user's nose and head, creating the air pocket as described herein. It is noted that the nose portion 150 may be constructed of foam, layered fabric, cloth or other suitable material that may allow for securely fitting or holding the facial covering 102 to the user's face. It may also be desired to add other adjustment portions, similar to the nose portion 150, in other locations in any of the components of the facial protection mask 100. As an example, it may be desired to place similar adjusting portions in alignment with the user's ears, thus providing additional supporting material. Additionally, it may also be desired to use adjusting portions to hold either the facial covering 102 and/or the head securing portion 104 away from other areas of the user's head, such as for example, holding the head securing portion 104 away from the user's ears. Foam strips may also be positioned in various locations using various shapes within or on the facial protection mask 100 to prevent eyewear fogging, create vapor seal (e.g., prevent eyewear fogging).

Figure 3:
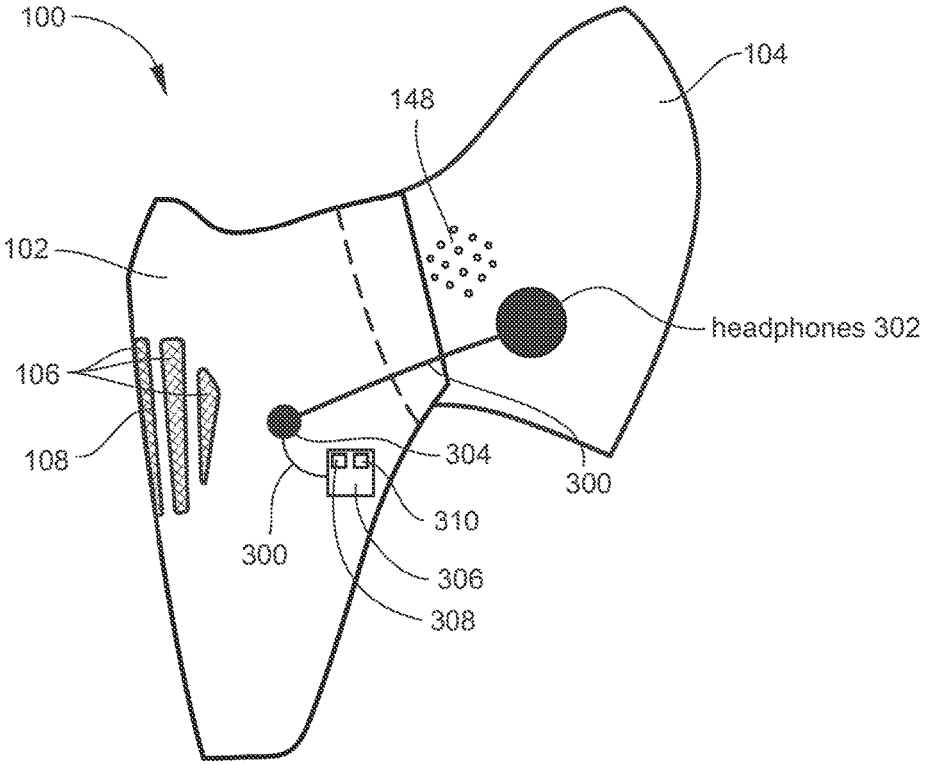
FIG. 3 illustrates an interior side view of the facial protection mask of FIG. 2 according to one embodiment of the present disclosure.

FIG. 3 is an illustration of an interior side view of the facial protection mask 100 of FIGS. 1 and 2 according to one embodiment of the present disclosure. FIG. 3 shows an example of interior electronics wiring 300. The wiring 300 may be placed in any position within the facial protection mask 100. The wiring 300 may be placed within, on the interior, and/or on the exterior surface(s) of the facial covering 102 or the head securing portion 104 as desired for supporting the use of various electronics needs of the user. As an example, the user may utilize one or more headphones 302 for hearing other climbers or listening to music. The headphones 302 may be placed on one or both sides of the head supporting portion 104 or the facial covering 102. Additionally, the facial protection mask 100 may also include a microphone 304 for receiving user speech for transmission via a processing unit 306 or transmission unit in the processing unit 306. The headphone(s) 302 and the microphone 304 may be stitched, bonded or layered within the components of the facial protection mask 100.

Alternative configurations of the facial protection mask 100 may include pockets sized for heat packs, speakers not in direct alignment with the ears (as distinct from headphones) allowing for safer communication, air filter inserts, wire or elastic cord channel inserts, and/or miscellaneous accessory attachments (e.g., decorative or function) for lighting or ventilation.

Additionally, the facial protection mask 100 may include a processing unit 306 electronically connected to either or both of the microphone 304 and/or the headphone(s) 302. The processing unit 306 may include a battery 308 and memory 310. The processing unit 306 may be stitched, bonded or layered within the components of the facial protection mask 100. The processing unit 306 may be configured to receive or transmit wireless communication from/to any wirelessly enabled device, such as, for example, a mobile communication device (e.g., mobile telephone, IPAD™, etc.). Communication may be enabled using BLUETOOTH™, WIFI™, cellular, radio and/or satellite transmissions. The processing unit 306 may further include a circuit configured to receive Global Positioning Satellite (GPS) signals.

Figure 4:
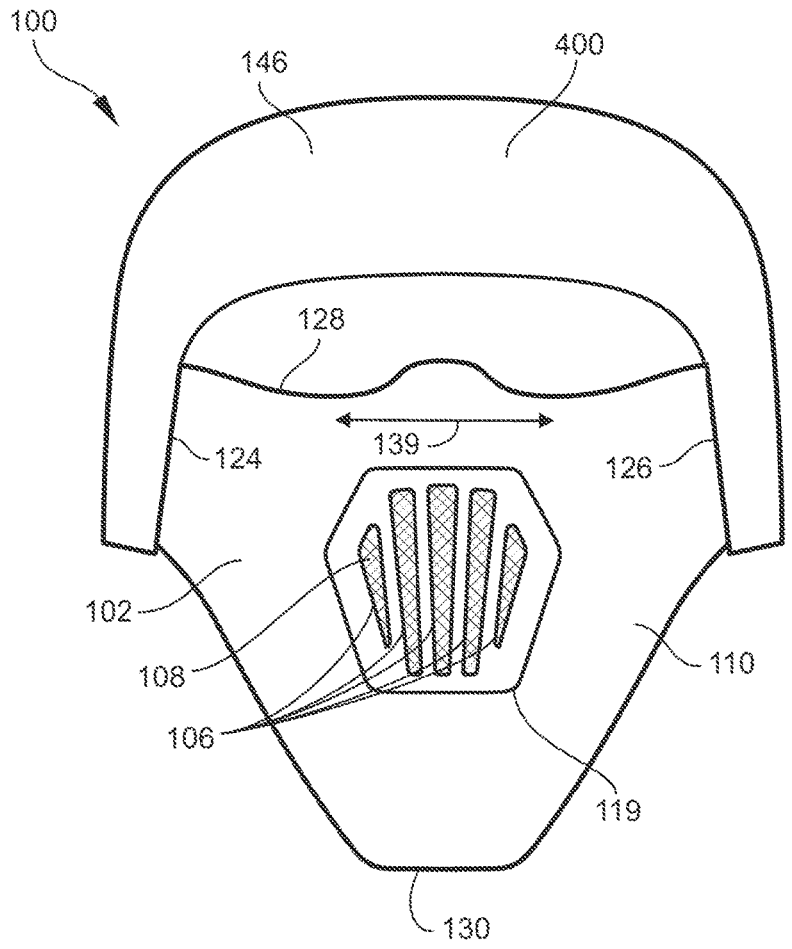
FIG. 4 is an exterior front view of another example of a facial protection mask for the protection of a user's face with an extended head securing portion according to another embodiment of the present disclosure.

FIG. 4 is an exterior front view of another example of a facial protection mask for the protection of a user's face with an extended head securing portion 400 according to another embodiment of the present disclosure. The extended head securing portion 400 may be desired to provide for additional support for the facial covering 102 on the face of the user. The extended head securing portion 400 may be in place of the head securing portion 104 as described above or in addition to. If the extended head securing portion 400 is used in addition to the head securing portion 104 it may be configured as a strap or band portion that is pulled over the user's head. The extended head securing portion 400 may be constructed of similar materials to that of the second material as described above (e.g., stretchable knit material). As an example, the user may desire to use the extended head securing portion 400 where the user will wear a helmet, stocking cap or other type of head covering that may cause unintended movement or adjustments to the alignment of the facial covering 102 on the user's face when used with the head securing portion 104 as described in FIGS. 1 and 2.

Figure 5:
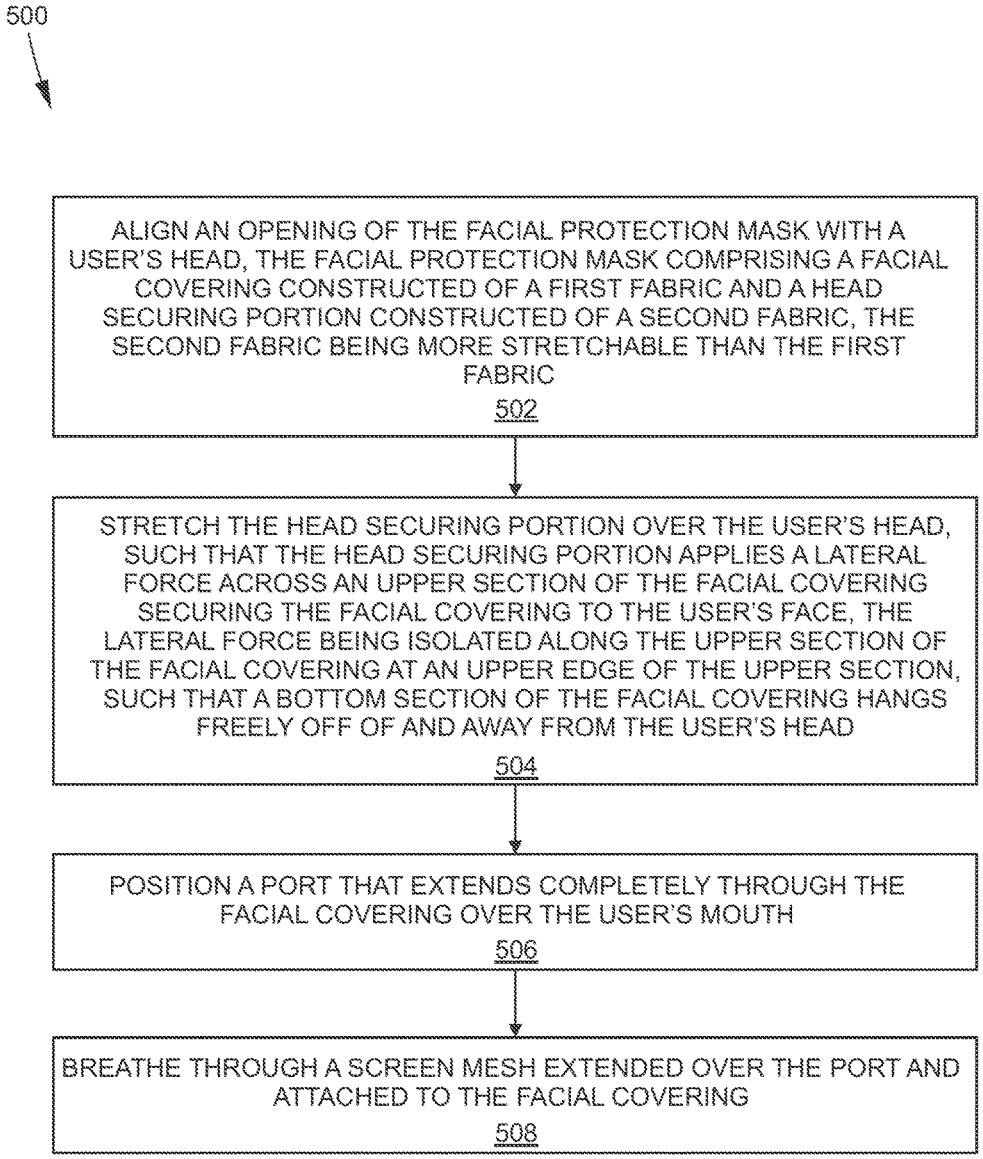
FIG. 5 illustrates a flow chart of an example method of use of the facial protection mask according to one embodiment of the present disclosure.

FIG. 5 illustrates a flow chart of an example method 500 of use of the facial protection mask 100 according to one embodiment of the present disclosure. A method for facial protection using a facial protection mask 100 includes aligning an opening of the facial protection mask 100 with the user's head, the facial protection mask 100 includes a facial covering 102 constructed of the first material 110 or fabric and the head securing portion 104 constructed of the second material 146 or fabric, the second material 146 being more stretchable than the first material 110 (Block 502). The method 500 also includes stretching the head securing portion 104 over the user's head, such that the head securing portion 104 applies the lateral force 139 across the upper section 136 of the facial covering 102 securing the facial covering 102 to the user's face. The lateral force 139 may be isolated along the upper section 136 of the facial covering 102 at an upper edge 128 of the upper section 136, such that a bottom section 138 of the facial covering 102 hangs freely off of and away from the user's head (Block 504). The method 500 may also include positioning the port 106 that extends completely through the facial covering 102 over the user's mouth (Block 506). The method may also include breathing through a screen mesh extended over the port and attached to the facial covering (Block 508).

Processing circuit(s) as used herein may comprise one or more processors, hardware circuits, firmware, memory or a combination thereof. Memory may comprise one or more volatile and/or non-volatile memory devices.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method for facial protection using a facial protection mask, the method comprising:

aligning an opening of the facial protection mask with, a user's head, the facial protection mask comprising a facial covering constructed of a first fabric and a head securing portion constructed of a second fabric, the second fabric being more stretchable than the first fabric, the facial covering comprising a first and second section bounded laterally by a first and second lateral edge, and the head securing portion comprising a first and second section bounded laterally by a first and second lateral edge;

stretching the head securing portion over the user's head, such that the head securing portion applies a lateral force across an upper section of the facial covering securing the facial covering to the user's face, the lateral force being substantially isolated along the upper section of the facial covering at an upper edge of the upper section, such that a bottom section of the facial covering hangs freely off of and away from the user's head;

positioning a port that extends completely through the facial covering over the user's mouth, wherein a screen mesh is extended over the port and attached to the facial covering.

2. The method of claim 1, wherein the screen mesh extends over the facial covering adjacent to the port and is bonded to the facial covering by a thermoplastic polyurethane (TPU) based material.

3. The method of claim 1, wherein the first fabric comprises a plurality of fabric layers with at least an exterior fabric layer and an interior fabric layer, the exterior fabric layer having a higher friction relative to the interior fabric layer.

4. The method of claim 1, wherein the first fabric comprises a plurality of layers that includes an exterior fabric layer, the exterior fabric layer being constructed of a reflective material.

5. The method of claim 1, wherein the head securing portion further comprises a plurality of holes in each of the first and second sections positioned to align with the user's ears.

6. The method of claim 1, wherein the second material is a knit material.

7. The method of claim 1, wherein the screen mesh is anti-microbial.

8. The method of claim 1, wherein the port comprises of a plurality of ports, each one of the plurality of ports are spaced apart from each of the other ports.

9. A facial protection mask to be worn by a user, the facial protection mask comprising:

a facial covering constructed of a first fabric, with a first side configured to face towards the user and an opposing second side, the first fabric being waterproof and breathable, the first fabric is configured to prevent the passage of water while allowing water vapor to pass through, the facial covering further comprising opposing first and second sections, the first and second sections are bounded laterally by a first and second lateral edge respectively;

a port extending completely through the facial covering and positioned to align with the user's mouth;

a screen mesh attached to the facial, covering and extending over the port, the screen mesh being more rigid than the first fabric, the screen mesh further being non-absorbent; and a head securing portion comprising opposing first and second sections, the first and second sections are bounded laterally by a first and second lateral edge respectively, wherein the opposing first and second sections are attached to the corresponding first and second sections of the facial covering, the head securing portion constructed from a second fabric different from the first fabric, wherein the second fabric being more stretchable than the first fabric, wherein the head securing portion and the facial covering form an enclosed opening configured to receive the user's head.

10. The facial protection mask of claim 9, wherein the screen mesh extends over the facial covering adjacent to the port and is bonded to the facial covering by a thermoplastic polyurethane (TPU) based material.

11. The facial protection mask of claim 9, wherein the first fabric comprises a plurality of fabric layers with at least an exterior fabric layer and an interior fabric layer, the exterior fabric layer having a higher friction relative to the interior fabric layer.

12. The facial protection mask of claim 9, wherein the first fabric comprises a plurality of fabric layers that includes an exterior fabric layer, the exterior fabric layer being constructed of a reflective material.

13. The facial protection mask of claim 9, wherein the first and second sections of each of the facial covering and the head securing portion are bounded laterally by first and second lateral edges; wherein the facial cove ng and the head securing portion each have an elongated shape in the horizontal direction between each of their respective lateral edges; and wherein the facial covering and the head securing portion each have a respective upper edge and a bottom edge.

14. The facial protection mask of claim 13, the facial covering further comprising an upper section that includes the upper edge and extends between the first and second lateral edges and a bottom section that includes the bottom edge, wherein the head securing portion applies a lateral force on the upper section of the facial covering, the lateral force being isolated along the upper section of the facial covering at the upper edge such that the bottom section hangs freely off of and away from the user's head.

15. The facial protection mask of claim 9, the head securing portion further comprising a plurality of holes in each of the first and second sections positioned to align with the user's ears.

16. The facial protection mask of claim 9, wherein the second material is a knit material.

17. The facial protection mask of claim 9, wherein the screen mesh is anti-microbial.

18. The facial protection mask of claim 9, wherein the port is comprised of a plurality of ports, each one of the plurality of ports are spaced apart from each of the other ports.

19. A facial protection mask to be worn by a user, the facial protection mask comprising:

a facial covering with a horizontal axis and a vertical axis, the horizontal axis being perpendicular to the vertical axis, wherein the facial covering is constructed of a first fabric with a first side configured to face towards the user and an opposing second side, the first fabric being waterproof and breathable, the first fabric is configured to prevent the passage of water while allowing water vapor to pass through, the facial covering further comprising opposing first and second sections;

a port extending completely through the facial covering and positioned to align with the user's mouth;

a screen mesh attached to the facial covering and extending over the port, the screen mesh being more rigid than the first fabric, the screen mesh further being non-absorbent; and a head securing portion comprising opposing first and second sections attached to the corresponding first and second sections of the facial covering, the head securing portion constructed from a second fabric different from the first fabric, wherein the second fabric is more stretchable than the first fabric, wherein the head securing portion and the facial covering form an enclosed opening configured to receive the user's head, and wherein the head securing portion is configured to apply a lateral force to an upper section of the facial covering at an upper edge of the facial covering parallel to the horizontal axis, such that a bottom section of the facial covering hangs freely off of and away from the user's head.

20. The facial protection mask of claim 19, wherein the screen mesh extends over the facial covering adjacent to the port and is bonded to the facial covering by a thermoplastic polyurethane (TPU) based material.

* * * * *